United States Patent [19]

Happach

[11] Patent Number: 4,621,247

[45] Date of Patent: Nov. 4, 1986

[54] HOUSING FOR CIRCUIT BREAKER

[75] Inventor: Anton Happach, Munich, Fed. Rep. of Germany

[73] Assignee: Schaltbau GmbH, Munich, Fed. Rep. of Germany

[21] Appl. No.: 642,944

[22] Filed: Aug. 21, 1984

[30] Foreign Application Priority Data

Aug. 25, 1983 [DE] Fed. Rep. of Germany ..... 3330666

[51] Int. Cl.[4] ..... H01H 45/04

[52] U.S. Cl. ..... 335/202; 335/132

[58] Field of Search ..... 335/132, 131, 202; 200/303

[56] References Cited

U.S. PATENT DOCUMENTS 3,259,702 7/1966 Burton et al. ..... 200/303

FOREIGN PATENT DOCUMENTS 53159 1/1967 German Democratic Rep. ..... 335/132

*Primary Examiner*—Harold Broome

*Attorney, Agent, or Firm*—Ralf H. Siegemund

[57] ABSTRACT

A completely closed two part casing for a circuit breaker and having a first part provided with compartments for receiving a magnetic drive, a movable contact bridge and a return spring; and a second part receiving stationary contacts cooperating with the bridge when the two parts are interconnected and protectively contain the contacts and contact bridge.

5 Claims, 5 Drawing Figures

HOUSING FOR CIRCUIT BREAKER

BACKGROUND OF THE INVENTION

The present invention is related to a two-part or two-shell casing or housing of insulative material for utilization of a single or double pole circuit breaker with twin circuit breaker points wherein in a first operating position contact pressure is established through compression springs acting upon contact bridges and wherein an attached armature biases a return spring which is stronger than the spring providing the contact pressure.

Casings for electrical circuit breakers are usually required to permit easy and fast manufacturing as well as easy and fast assembly of the circuit breaker. Moreover, easy and rapid access to the interior is required, for example, in case failure has been observed so that the error situation can be easily remedied. This is particularly true in cases when the circuit breaker is used, for example, in electrically driven railless vehicles or in automobiles running with electric power. In such instances it cannot be expected that maintenance is carried out regularly and/or through properly trained personnel.

DESCRIPTION OF THE INVENTION

It is an object of the present invention to provide a new and improved circuit breaker of the type outlined above permitting easy and fast manufacture, testing, maintenance and repair.

In accordance with the preferred embodiment of the present invention it is suggested to provide a first shell or casing portion having appropriate indents to receive the elements of the magnetic drive as well as the movable contacts and the return spring while the second shell is provided with stationary contacts and both shells are suitably interconnected.

In a particularly advantageous configuration for practicing the best mode of the invention, it is suggested to provide a U shaped yoke having its legs seated on the bottom of the first mentioned shell or casing cart in between the inner U bottom and an eye formed at the bottom of the first mentioned shell the coil body with coil and core is clamped. The eye has a length corresponding to the lifting stroke of the armature. The yoke, the core and the eye are provided with aligned bores and threaded connections as run there through. The armature is provided with a recess or indent which is concentric to the first mentioned bores to permit a free play of the armature about the eye. Moreover, the armature is provided with a fastener and actuator extension for holding the contact bridge in resting position. Finally, the return spring is tensioned against the first shell by means of a holder penetrating the first shell and by means of a fastening element positioning and holding the holder on the outside of that first shell.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates the first shell, housing or casing part 1. This casing part is provided (a) for mounting a two-pole circuit breaker is with double circuit breaking points. The circuit breaker has an U shaped yoke 2. In addition, the case receives a single pole circuit breaker with twin circuit breaking action having an U shaped yoke 3. The view is into this particular casing part and the hatched surface is in fact the plane of the shell or casing part 1 beyond which none of the elements mounted in the shell 1 will project. This surface is, in face, provided for abutment to correspondingly hatched parts of the second shell or casing part 1*a* which is illustrated in FIG. 2. The two shell or housing parts have several partitions for defining individual chambers. The partitioning of the two shell and casing parts is not identical but there is adequate communality in configuration to obtain in parts a surface-to-surface abutment when the two shells are placed together for completing the assembly of the circuit breaker.

A screw 9 having a head 4 penetrates, as shown in FIG. 3, the yoke 2 and engages a circuit breaker core 6 situated in a coil body 5. The core 6 is tensioned against the bottom of the shell 1 by means of another screw 7 which is run through an eye 8. Reference numeral 10 refers to the armature of the double pole circuit breaker, carrying actuator vanes or bars 12. As shown in FIG. 4, these bars 12 hold the crimped contact bridge 16 open under the force of the return spring, against the springs 14 providing the contact making pressure. Return spring action will be explained below with reference to FIG. 5. As the solenoid or coil in the circuit breaker is energized, the actuating arms 12 on armature 10 are lifted, and the contact bridge 16 will now be urged into a contact making position (contacts 15) by operation of the contact springs 14. In particular, the contact bridge 16 will now be urged against the stationary contacts 15 which are mounted in the casing 1*a*. As shown in FIG. 2, the stationary contacts 15 are secured to the inside of the second shell 1*a* depicted in FIG. 2. Connection facilities are provided on the outside of that shell or casing part 1*a* in order to provide for the requisite external electrical connection. Whenever the two shells 1 and 1*a* are interconnected, the stationary contacts 15 coincide with the axis of indents 17 shown in FIG. 4 and which receive the contact making compression springs 14. The position is approximately as shown in FIG. 4 in this instant.

The return spring 19 has a function which will be explained with reference to FIGS. 1 and 5. The armature 10 carries two supports 18 for the return springs 19. FIG. 5 illustrates an operating state of the armature 10 in which contact making is provided for whereby the armature causes the return springs 19, through the supports 18, to be tensioned vis-a-vis the spring guide elements 20 and the fastening element 21 with respect to the housing or casing part 1. Fastener 21 secures guide 20 to part 1.

Figure 1:
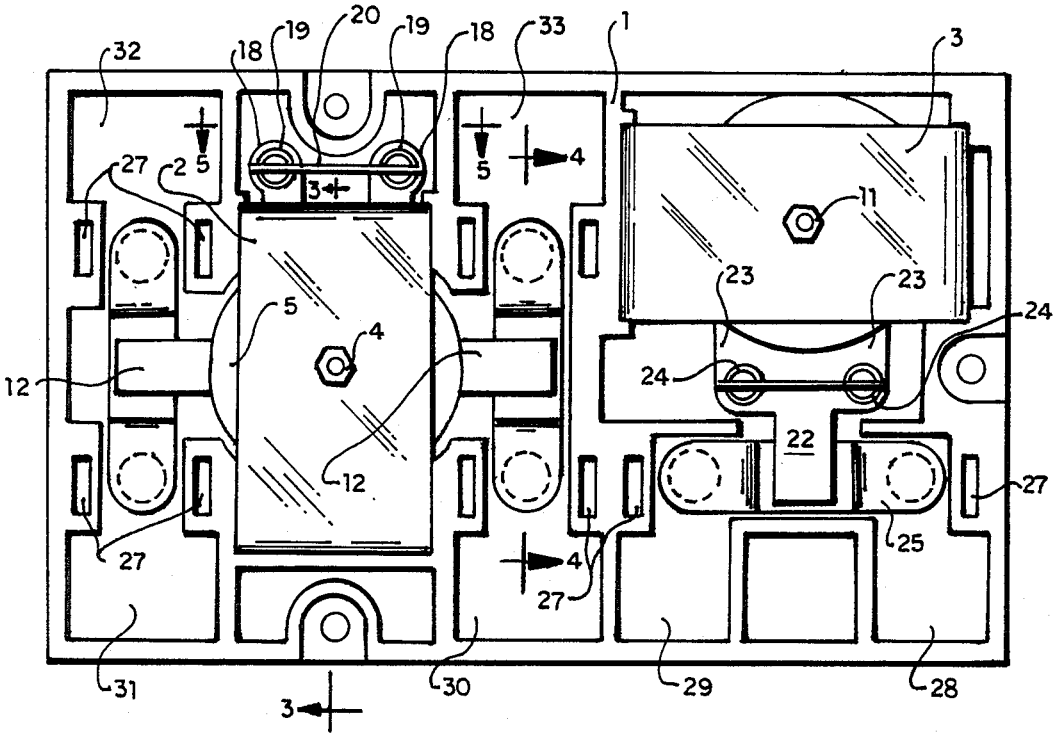
FIG. 1 is a somewhat schematic view into one (the first one) of the shells and housing parts for a circuit breaker and constructed in accordance with the preferred embodiment of the present invention for practicing the best mode thereof.

These various aspects have immediate validity and have been explained with respect to the two-pole circuit breaker in the left hand portion of FIG. 1. The single pole circuit breaker is operated and mounted analogously. That circuit breaker has an armature which is provided with actuator bars 22 and a return spring 24 bearing against support 23. The contact bridge is designated by reference numeral 25 in the drawing and cooperates with stationary contacts 26 as can be seen particularly in FIG. 2 because also here the stationary contacts are mounted in this second casing and shell part.

By means of screws such as 9 and/or 11, one may provide printed circuits on the outer bottom of the U defined by the yokes 2 and/or 3. These printed circuit boards are not shown but the casing part is provided for suitable accomodation in this regard. The circuits on the circuit boards will provide for the requisite control of the circuit breaker coil and its current flow. Contacts extending therefrom in outer direction may be configured in forms of pins and are arranged inside a collar which may penetrate a suitable indent of the second shell shown in FIG. 2 but again it is required that these elements will not project beyond the particular surface outlined in FIG. 2 by the cross hatching.

If for some reason the circuit breaker is to be operated with dc, it is necessary to provide for arc blowing. Accordingly, the first shell 1 is provided on both sides of the circuit breaker points with pockets and/or recesses 27 which will recieve such blowing magnets.

Both shells or housing parts are provided with further indents designated respectively for the two shells by reference numerals 28 through 33. These indent form pairs whereby the two indents per pair are in different housing parts. Each pair establishes an arc extinguishing chamber whenever the two shells and housing pieces are combined.

A problem arises generally for checking on individual components even after the two shells and housing parts have been combined. In order to permit such inspection it is suggested to provide the first shell and/or housing part 1 with perforations or windows which can be closed through slide elements but these elements are to be operated from the outside in order to avoid soiling and dirt accumulation in the interior of the housing. Upon opening any of these slides it is possible to observe for example the condition of the contacts for example or to provide an inspection with regard to operability of components. The two housing parts are interconnected by means of bolts or clamps.

Figure 2:
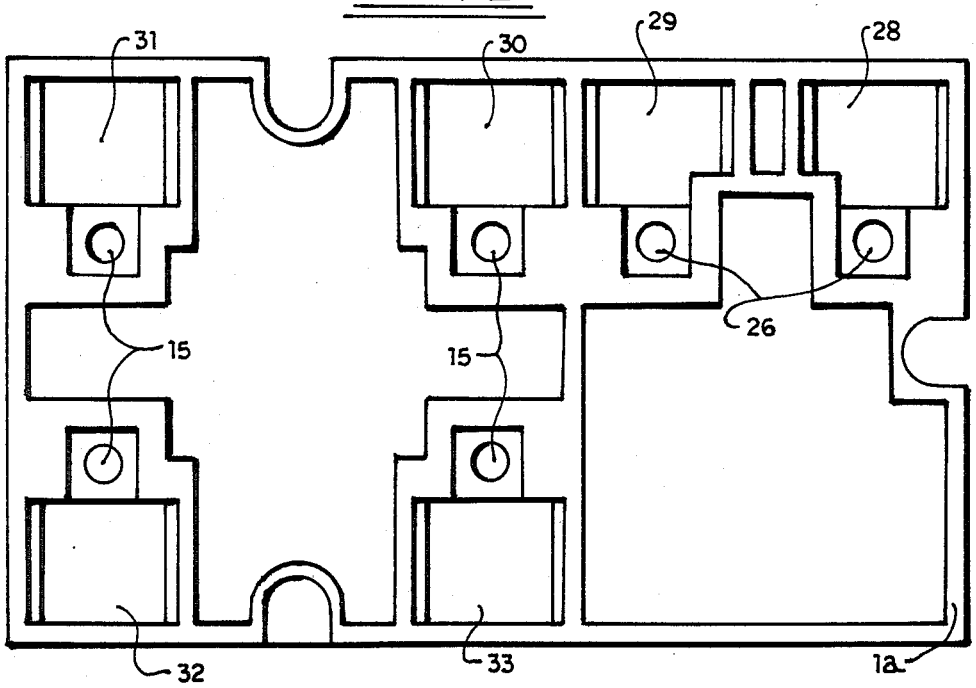
FIG. 2 is a view into the complementary or second shell or casing part.
Figure 3:
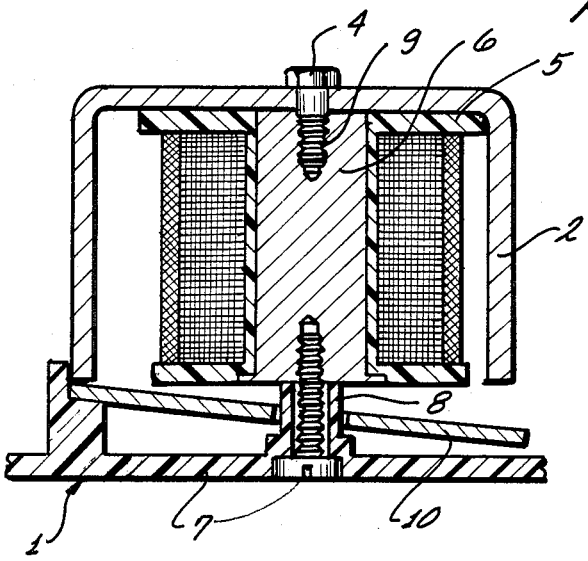
FIG. 3 is a cross sectional view as through a portion of the shell configuration of FIG. 1.
Figure 4:
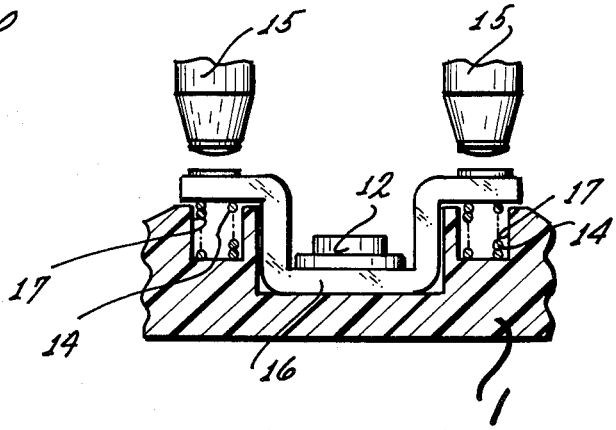
FIG. 4 is a section through a detail of the circuit breaker shown in FIG. 1.
Figure 5:
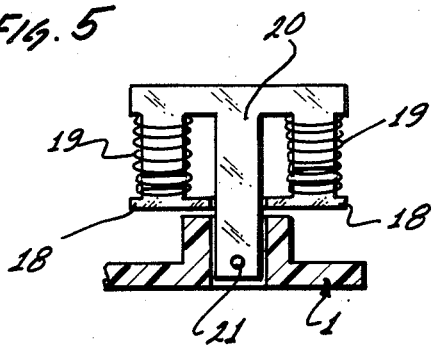
FIG. 5 is a schematic section view through another detail of the same circuit breaker.

It can readily be seen that the particular configuration illustrated is of an exemplary nature only. The rather complex housing is provided for accomodating two different types of circuit breakers. The FIGS. 1 and 2 illustrate in effect a central partition with a large portion on one side and there is a smaller portion on the other side respectively for the two different circuit breakers. Instead, of course, the housings could end at that partition and one could have therefore two separate kinds of housings for the two different circuit breakers. On the other hand, it can readily be seen that larger assemblies can be made for accomodating larger number of circuit breakers. As circuit breakers of the same type are to be combined a certain symmetry will be observed in the construction of the housing parts to be combined.

The invention is not limited to the embodiments described above but all changes and modifications thereof, not constituting departures from the spirit and scope of the invention, are intended to be included.

I claim:

1. In a circuit breaker configuration wherein the circuit breaker is provided with a magnetic drive and armature for operating a movable contact bridge cooperating with stationary contacts and further having return spring means and contact pressure providing springs, the improvement comprising:

a two part casing comprising a first casing part provided with compartments receiving said magnetic drive, said contact bridge, and said return spring; and a second casing part receiving said stationary contacts; and said two casing parts being interconnected so that said stationary contacts face said movable contact bridge, and said contacts, bridge and drive are protectively contained inside the casing being completely closed.

2. Circuit breaker as in claim 1, said first part having an eye for receiving a fastener for fastening a coil-core combination of said magnetic drive to said eye and said first casing, a U shaped yoke being fastened to said coil-core combination, said magnetic drive having an armature provided with a wide opening through which said eye projects, said armature provided with actuating extension for holding said contact bridge.

3. Circuit breaker as in claim 1, said return spring being held against and tensioned against said first casing part.

4. Circuit breaker as in claim 2, said first casing part having pockets for receiving blower magnets.

5. Circuit breaker as in claim 1, said parts having partitions defining complementary chambers.

* * * * *